United States Patent [19]

Williams

[11] Patent Number: 4,763,714

[45] Date of Patent: Aug. 16, 1988

[54] DUAL WALL PARTITION

[75] Inventor: Charles E. Williams, Delavan, Wis.

[73] Assignee: Hough Manufacturing Corporation, Janesville, Wis.

[21] Appl. No.: 21,586

[22] Filed: Mar. 2, 1987

Related U.S. Application Data

[63] Continuation of Ser. No. 756,077, Jul. 17, 1985, abandoned.

[51] Int. Cl.[4] ..... E05D 15/06

[52] U.S. Cl. ..... 160/200; 160/199; 49/127; 52/64

[58] Field of Search ..... 160/196 R, 196 D, 198, 160/200, 205, 204, 136, 159, 197, 199, 113, 118; 49/127, 125; 52/64, 71

[56] References Cited

U.S. PATENT DOCUMENTS

| | | | |
|---|---|---|---|
| 2,027,992 | 1/1936 | Maurer | 160/159 |
| 2,614,627 | 10/1952 | Miller | 160/199 |
| 2,658,571 | 11/1953 | Guth et al. | 160/197 X |
| 2,754,902 | 7/1956 | Attkisson | 160/196 X |
| 2,952,312 | 9/1960 | Young et al. | 160/159 |
| 3,235,915 | 2/1966 | Glaser | 160/199 |
| 3,300,899 | 1/1967 | Haws et al. | 49/127 X |
| 3,331,426 | 7/1967 | Ensign | 160/199 |
| 3,494,407 | 2/1970 | Hollands et al. | 160/199 |
| 3,879,799 | 4/1975 | Williams | 16/104 X |
| 4,569,164 | 2/1986 | Dickson | 160/196 R X |

*Primary Examiner*—Ramon S. Britts
*Assistant Examiner*—David M. Purol
*Attorney, Agent, or Firm*—Michael, Best & Friedrich

[57] ABSTRACT

A dual wall partition comprising, in combination, first and second generally planar panels, and hinge apparatus supporting the panels in generally parallel, generally opposed relationship, the hinge apparatus extending between the panels for permitting a range of movement of the panels relative to each other to vary the spacing therebetween from a maximum determined by the hinge apparatus to selected spacings which are less than the maximum and so that the panels remain substantially parallel throughout the range of movement.

17 Claims, 1 Drawing Sheet

DUAL WALL PARTITION

This is a continuation of co-pending application Ser. No. 756,077 filed on July 17, 1985 now abandoned.

BACKGROUND OF THE INVENTION

The invention relates to movable walls or partitions and more particularly to movable walls or partitions of the type running on overhead tracks and used to divide large rooms such as conference rooms or ballrooms into smaller rooms.

Single panel movable partitions are well known in the art. These partitions typically include a plurality of individual panels aligned in end-to-end relationship. The panels are movable along an overhead track spanning the room to be divided and can be stored either at one end of the track or in a remote area when the room is not divided.

Dual panel movable partitions are also known in the art. For example, see U.S. Pat. Nos. 3,979,861, to Fromme and 4,027,714. to Dixon. The dual wall partitions disclosed in these patents are of the accordian type and require complicated connecting mechanisms between adjacent panels. Also, when the panels are arranged to form a partition, the joints between the panels of one row are directly opposite the joints between the panels of the other row. This can result in unsatisfactory acoustical and fire proofing performance.

SUMMARY OF THE INVENTION

The invention provides a dual wall partition comprising a plurality of first panels each having opposite generally vertical end surfaces, and a plurality of second panels each having opposite generally vertical end surfaces, with the first panels extending in aligned, end-to-end relationship, and with the second panels extending in aligned, end-to-end relationship and in generally parallel, generally opposed relationship with the first panels, so that each of the first panels is positioned generally opposite one of the second panels.

The partition also comprises a pair of hinge apparatus extending between each of the pairs of parallel panels to form a parallelogram. Each hinge apparatus preferably includes an elongated linkage having opposite ends and a generally vertical pivot axis intermediate the opposite ends. The hinge apparatus further includes a first member fixedly connected to the associated first panel, and a second member fixedly connected to the associated second panel. One end of the elongated linkage is pivotally connected to the first member for rotation relative thereto about a generally vertical axis, and the opposite end of the elongated linkage is pivotally connected to the second member for rotation relative thereto about a generally vertical axis. Thus, one end of the elongated linkage is pivotally connected to the associated first panel, and the other end of the elongated linkage is pivotally connected to the associated second panel.

The hinge apparatus further includes a pivot linkage having an upper end adapted to be movably connected to track means along which the partition moves, and a lower end pivotally connected to the elongated linkage for rotation of the elongated linkage relative to the track means about the above-mentioned vertical pivot axis.

In a first position, the elongated linkage extends generally perpendicularly to the panels and the panels are separated by a distance approximately equal to the length of the linkage. In a second position, the elongated linkage is rotated approximately 90° relative to the first position (or parallel to the panels) and the panels are separated by a distance approximately equal to the width of the linkage. Thus, the hinge apparatus permits a range of movement of the connected panels relative to each other to vary the spacing therebetween from a maximum determined by the length of the elongated linkage to a minimum determined by the width of the elongated linkage and so that the panels remain substantially parallel throughout the range of movement. Furthermore, when a plurality of pairs of first and second panels are arranged end-to-end, the hinge apparatus permits this range of movement of the first and second panels to vary the spacing therebetween with the panels remaining in end-to-end relationship throughout the range of movement. Preferably, when the panels are arranged end-to-end to form a partition, the elongated linkages are in the first position so that the spacing between the first and second panels is at a maximum. When the panels are stacked up for storage, the elongated linkages are in the second position so that the spacing between the panels is at a minimum.

Furthermore, the hinge apparatus are preferably connected to the panels so that when the panels are arranged end-to-end to form a partition and when the elongated linkages are in the first position to maximize the spacing between the panels, the joints between adjacent first panels are horizontally offset in the direction of the panels from the joints between adjacent second panels. This provides improved fireproofing and acoustical performance.

A principal feature of the invention is the provision of a relatively simple dual wall partition which allows variation of the spacing between the rows of panels and which has nonaligned joints between adjacent panels.

Other principal features and advantages of the invention will become apparent to those skilled in the art upon review of the following detailed description, claims, and drawings.

Figure 1:
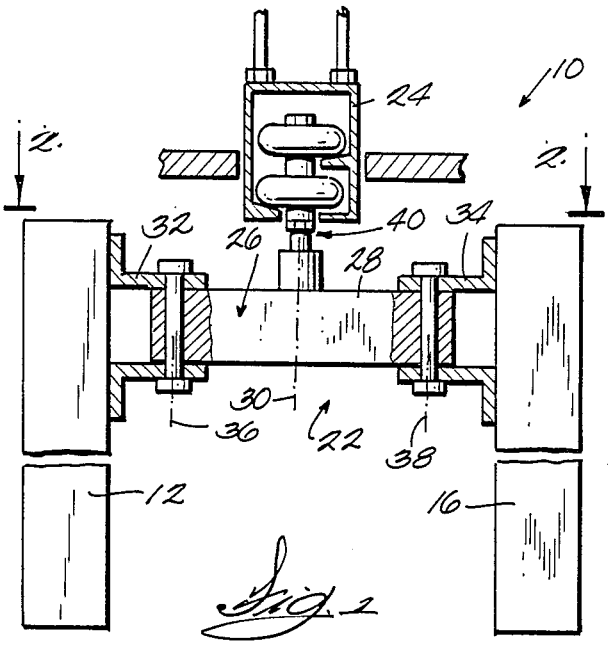
FIG. 1 is a vertical cross-sectional view of a dual wall partition embodying the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Figure 3:
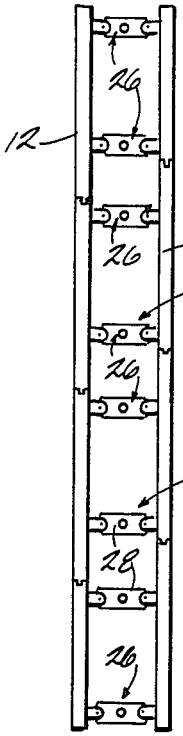
FIG. 3 is a reduced view similar to FIG. 2 showing the entire partition.
Figure 2:
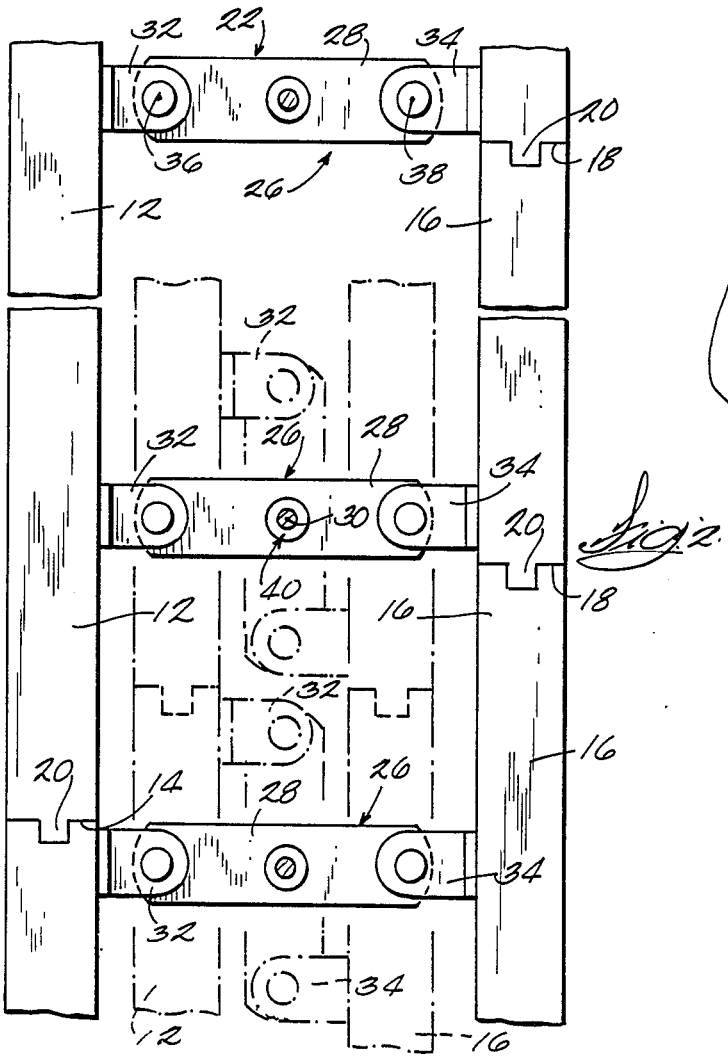
FIG. 2 is a cross-sectional view taken along line 2—2 in FIG. 1.
Figure 4:
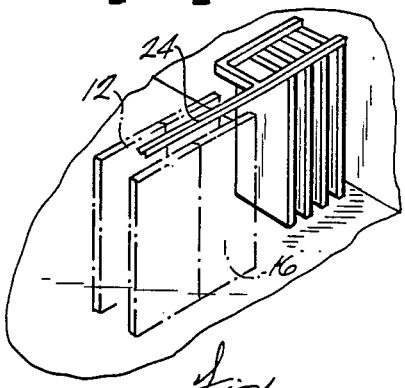
FIG. 4 is a perspective view of the panels of the partition being stacked for storage.

A dual wall partition 10 embodying the invention is illustrated in the drawings. As best shown in FIGS. 2 through 4, the partition 10 comprises a plurality of first or left panels 12 each having opposite, generally vertical end surfaces 14, and a plurality of second or right panels 16 each having opposite, generally vertical end surfaces 18. In the preferred embodiment, as best shown in FIG. 2, the panels 12 and 16 include tongue and groove means 20 which, when the panels 12 or 16 are aligned end-to-end, interconnects adjacent end surfaces 14 or 18 of the panels 12 or 16. The tongue and groove means 20 serves both to align adjacent panels and to close the space between adjacent panels when the end surfaces of the panels are not in exact abutment.

The partition 10 also comprises means for supporting the first or left panels 12 in aligned, end-to-end relationship, and for supporting the second or right panels 16 in aligned, end-to-end relationship and in generally parallel, generally opposed relationship with the first panels 12. This relationship is best shown in FIG. 3. The supporting means preferably includes connecting means 22 extending between the left and right panels 12 and 16 for permitting a range of movement of the left and right panels relative to each other to vary the spacing therebetween from a maximum determined by the connecting means 22 to selected spacings which are less than the maximum and so that the panels 12 and 16 remain substantially parallel and in end-to-end relationship throughout the range of movement. The supporting means also supports the panels 12 and 16 for movement along a generally horizontal track 24, as is known in the art. The track 24 and the means by which the partition 10 is supported on the track 24 is explained in greater detail hereinafter.

In the preferred embodiment, as best shown in FIG. 3, the supporting means includes a pair of the connecting means 22 extending between each pair of opposed left and right panels 12 and 16 at spaced points on the panels so that the pair of connecting means 22 and the opposed panels 12 and 16 generally form a parallelogram. In the preferred embodiment, the supporting means also includes an additional pair or pairs of connecting means (not shown) between the lower ends of each pair of opposed panels.

Preferably, as best shown in FIGS. 1 and 2, the connecting means 22 includes a hinge apparatus 26 comprising an elongated linkage 28 having opposite first and second or left and right ends, and a generally vertical pivot axis 30 intermediate the opposite ends. The hinge apparatus 26 preferably also comprises a first or left member 32 fixedly connected to the associated left panel 12, and a second or right member 34 fixedly connected to the associated second or right panel 16. The left end of the elongated linkage 28 is pivotally connected to the left member 32 for rotation relative to the left member 32 and to the left panel 12 about a first generally vertical pivot axis 36, and the right end of the elongated linkage 28 is pivotally connected to the right member 34 for rotation relative to the right member 34 and to the right panel 16 about a second generally vertical pivot axis 38.

Thus, in a first position (illustrated in solid lines in FIG. 2), the elongated linkage 28 extends generally perpendicularly to the panels 12 and 16 and the panels are separated by a distance approximately equal to the length of the elongated linkage 28. In a second position (illustrated in dotted lines in FIG. 2), the elongated linkage 28 is rotated approximately 90° relative to the first position, or parallel to the panels 12 and 16, and the panels are separated by a distance approximately equal to the width of the elongated linkage 28.

The hinge apparatus 26 also comprises means for mounting the elongated linkage 28 on the track 24 for horizontal movement along the track 24 and for rotation relative to the track 24 about the pivot axis 30. While various suitable mounting means can be employed, in the preferred embodiment, the mounting means includes a pivot linkage 40 having an upper end movably connected to the track 24, and a lower end connected to the elongated linkage 28 for rotation of the elongated linkage 28 relative to the track 24 about the pivot axis 30. Preferably, the track 24 and the pivot linkage 40 are part of a multidirectional suspension system such as disclosed in U.S. Pat. No. 3,879,799, which is incorporated herein by reference. However, any suitable track or suspension system is within the scope of the invention.

Figure 5:
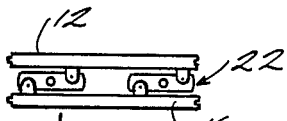
FIG. 5 is a top view of a pair of panels collapsed for storage.

In the preferred embodiment, the hinge apparatus 26 are connected to the panels 12 and 16 as shown in FIG. 3, such that when the spacing between the panels is at the maximum (the preferred spacing when the panels are arranged as a partition), the joints between the end surfaces 14 of the left panels 12 are horizontally offset in the direction of the panels (vertically in FIG. 3) from the joints between the end surfaces 18 of the right panels 16. This provides improved acoustical and fireproofing performance, since sound and fire must follow a staggered path through the joints in the two rows of panels. One exception to this is the end panels adjacent a room wall. There the end surfaces are directly opposite and each abuts the wall. When the spacing between the panels is at a minimum, and when the panels are arranged in end-to-end relationship, the joints between the end surfaces 14 of the left panels 12 are positioned generally directly opposite the joints between the end surfaces 18 of the right panels 16. This is shown in FIG. 2. Stated alternatively, when the spacing between the panels is at a minimum, the end surfaces 14 of the left panel 12 of any pair of panels are positioned generally directly opposite the end surfaces 18 of the right panel 16 of that pair. This is shown in FIG. 5.

It should be noted that, as shown in FIG. 3, due to the offset of the joints between the panels, one of the end panels (the lower panel in FIG. 3) of the row of left panels 12 and one of the end panels (the upper panel in FIG. 3) of the row of right panels 16 is shorter than the remaining panels.

Figure 6:
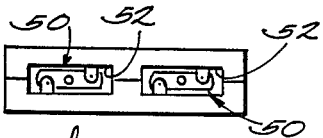
FIG. 6 is a top view of a pair of panels showing an alternative embodiment of the invention.

An alternative embodiment of the invention is illustrated in FIG. 6. In the alternative embodiment, the hinge apparatus 50 are connected within recesses 52 in opposed panels so that the panels can be collapsed with no space in between.

Various other features of the invention are set forth in the following claims.

I claim:

1. A dual wall partition comprising, in combination, a track having a logitudinal axis, first and second generally planar panels, means for supporting said panels from said track for movement along said track in the direction of the longitudinal axis, and connecting means extending between said panels for supporting said panels in generally parallel, opposed, facing relationship and in generally parallel relationship to the longitudinal axis, said connecting means also connecting said panels for movement of said panels relative to each other while maintaining the generally parallel, generally opposed relationship therebetween and relative to the track while varying the spacing therebetween from a maximum to selected spacings which are less than said maximum so that said panels separate areas on opposite sides of said partition and said separation is maintained throughout the range of relative movement of said panels.

2. The dual wall partition of claim 1 wherein said partition comprises a plurality of said connecting means extending between said panels at spaced points on said panels so that an adjacent pair of said connecting means and said panels generally form a parallelogram.

3. A dual wall partition as set forth in claim 1 wherein said connecting means includes a hinge apparatus comprising an elongated linkage having opposite first and second ends and a pivot axis intermediate said opposite ends, said first end being pivotally connected to said first panel for rotation relative to said first panel about a first axis parallel to said pivot axis, and second end being pivotally connected to said second panel for rotation relative to said second panel about a second axis parallel to said pivot axis.

4. A dual wall partition as set forth in claim 3 wherein said partition comprises a pair of said hinge apparatus extending between said panels at spaced points on said panels so that said hinge apparatus and said panels generally form a parallelogram.

5. A dual wall partition as set forth in claim 3 wherein said apparatus also comprises means for mounting said elongated linkage on said track for common movement along said track in a direction transverse to said pivot axis and for rotation relative to said track about said pivot axis.

6. A dual wall partition as set forth in claim 5 wherein said elongated linkage mounting means includes a pivot linkage having a first end movably connected to said track and a second end connected to said elongated linkage for rotataion of said elongated linkage relative to said track about said pivot axis.

7. A dual wall partition as set forth in claim 3 wherein said hinge apparatus further comprises a first member fixedly connected to said first panel, and a second member fixedly connected to said second panel, wherein said first end of said elongated linkage is pivotally connected to said first member for rotation relative to said first member about said first axis, and wherein said second end of said elongated linkage is pivotally connected to said second member for rotation relative to said second member about said second axis.

8. A dual wall partition as set forth in claim 1 wherein said panels are supported for movement along the longitudinal axis, and are supported on opposite sides of the longitudinal axis.

9. A dual wall partition comprising a plurality of first panels each having opposite generally vertical end surfaces with adjacent end surfaces defining joints between said first panels, a plurality of second panels each having opposite generally vertical end surfaces with adjacent end surfaces defining joints between said second panels, and means for supporting said first panels in aligned, generally coplanar end-to-end relationship, and for supporting said second panels in aligned, generally coplanar end-to-end relationship and in generally parallel, spaced apart relationship with said first panels, said supporting means including connecting means extending between said first and second panels for supporting said panels so that said first and second panels are movable toward and away from each other to vary the spacing therebetween for maintaining said first and second panels substantially parallel to each other, while said panels are being moved toward and away from each other, for maintaining said first panels in generally coplanar end-to-end relationship, and for maintaining said second panels in generally coplanar end-to-end relationship.

10. A dual wall partition as set forth in claim 9 wherein, when the spacing between said first and second panels is at said maximum, the joints between the end surfaces of said first panels are horizontally offset in the direction of said panels from the joints between the end surfaces of said second panels, and, when the spacing between said first and second panels is at a minimum, the joints between said end surfaces of said first panels are positioned generally directly opposite the joints between said end surfaces of said second panels.

11. A dual wall partition as set forth in claim 9 wherein said connecting means extends between opposed pairs of said first and second panels for permitting a range of movement of the panels of said pairs relative to each other.

12. A dual wall partition as set forth in claim 11 wherein, when the spacing between the panels of said pairs is at said maximum, the end surfaces of the first panels of said pairs are horizontally offset in the direction of said panels from the end surfaces of the second panels of said pairs, and, when the spacing between the panels of said pairs is at a minimum, the end surfaces of the first panels of said pairs are positioned generally directly opposite the end surfaces of the second panels of said pairs.

13. A dual wall partition as set forth in claim 9 wherein said connecting means includes a plurality of elongated linkages each having opposite first and second ends, a length, a width, and a pivot axis intermediate said opposite ends, said first end being pivotally connected to one of said first panels for rotation relative to said one of said first panels about a first axis parallel to said pivot axis, and said second end being pivotally connected to the second panel opposite said one of said first panels for rotation relative to said opposite second panel about a second axis parallel to said pivot axis, whereby, in a first position, said elongated linkages extend generally perpendicularly to said panels and said panels are separated by a distance approximately equal to the lengths of said elongated linkages, and the joints between the end surfaces of said first panels are horizontally offset in the direction of said panels from the joints between the end surfaces of said second panels, and, in a second position, said elongated linkages are rotated approximately 90° relative to said first position and said panels are separated by a distance approximately equal to the widths of said elongated linkages, and the joints between said end surfaces of said first panels are positioned generally directly opposite the joints between said end surfaces of said second panels.

14. A dual wall partition as set forth in claim 9 wherein said first panels include tongue and groove means interconnecting adjacent end surfaces of said first panels, and wherein said second panels include tongue and groove means interconnecting adjacent end surfaces of said second panels.

15. A dual wall partition as set forth in claim 9 wherein said partition is adapted to be supported by a track having a longitudinal axis, wherein said first and second panels are supported by the track for movement along the longitudinal axis, and wherein said first and second panels are supported on opposite sides of the longitudinal axis.

16. A dual wall partition comprising a track, a pair of spaced apart, generally planar, generally parallel panels adapted to be positioned in opposed facing relation, a first hinge apparatus including a first elongated linkage having opposite ends and a first vertical pivot axis located intermediate said opposite ends, one of said ends being pivotally connected to one of said panels for pivotal movement relative thereto about an axis parallel to said pivot axis, and the other of said end being pivotally connected to the other of said panels for pivotal movment relative thereto about an axis parallel to said pivot axis, and a first pivot linkage having a first end movably connected to said track for movement thereon in a direction transverse to said pivot axis, and a second end connected to said first linkage for supporting said panels and for permitting pivotal movement of said first linkage relative to said track about said pivot axis, and a second hinge apparatus including a second elongated linkage having opposite ends and being parallel to said first elongated linkage, said second elongated linkage including a second vertical pivot axis parallel to said first pivot axis and located intermediate said opposite ends of said second linkage, one of said ends of said second linkage being pivotally connected to one of said panels for pivotal movement relative thereto about an axis parallel to said second pivot axis, and the other of said ends of said second linkage being pivotally connected to the other of said panels for pivotal movement relative thereto about an axis parallel to said second pivot axis, and a second pivot linkage having a first end movably connected to said track for movement thereon in said direction, and a second end connected to said second linkage for supporting said panels and for permitting pivotal movement of said secong linkage relative to said track about said second pivot axis.

17. A dual wall partition as set forth in claim 16 wherein the track has a longitudinal axis, wherein said first end of said first pivot linkage is adapted to be connected to the track for movement along the longitudinal axis, wherein said first end of said second pivot linkage is connected to the track to movement along the longitudinal axis, and wherein said panels are supported on opposite sides of the longitudinal axis.

* * * * *

UNITED STATES PATENT AND TRADEMARK OFFICE

CERTIFICATE OF CORRECTION

PATENT NO. : 4,763,714

DATED : August 16, 1988

INVENTOR(S) : Charles E. Williams

It is certified that error appears in the above-identified patent and that said Letters Patent is hereby corrected as shown below:

Column 5, line 24, before "second" insert --said--.

Column 5, line 43, "rotataion" should be --rotation--.

Column 7, line 25, "movment" should be --movement--.

Column 8, line 29, second occurrence of "to" should be --for--.

Signed and Sealed this

Twenty-first Day of February, 1989

*Attest:*

DONALD J. QUIGG

*Attesting Officer*

*Commissioner of Patents and Trademarks*